US011534777B2

(12) United States Patent
Goisot et al.

(10) Patent No.: US 11,534,777 B2
(45) Date of Patent: Dec. 27, 2022

(54) COATING SPRAYER, METHOD FOR ASSEMBLING AND DISASSEMBLING

(71) Applicant: EXEL INDUSTRIES, Epernay (FR)

(72) Inventors: Gilles Goisot, Paris (FR); Sylvain Perinet, Paris (FR); Cédric Le Strat, Paris (FR); Nicolas Bertrand, Paris (FR)

(73) Assignee: EXEL INDUSTRIES, Epernay (FR)

( * ) Notice: Subject to any disclaimer, the term of this patent is extended or adjusted under 35 U.S.C. 154(b) by 308 days.

(21) Appl. No.: 15/446,383

(22) Filed: Mar. 1, 2017

(65) Prior Publication Data

US 2017/0266672 A1 Sep. 21, 2017

(30) Foreign Application Priority Data

Mar. 21, 2016 (FR) ..... 1652390

(51) Int. Cl.

| | |
|---|---|
| ***B05B 5/04*** | (2006.01) |
| ***B05B 3/04*** | (2006.01) |
| ***B05B 3/10*** | (2006.01) |
| ***B05B 15/60*** | (2018.01) |

(52) U.S. Cl.

CPC ..... *B05B 3/0422* (2013.01); *B05B 3/1092* (2013.01); *B05B 5/0426* (2013.01); *B05B 15/60* (2018.02)

(58) Field of Classification Search

CPC ..... B05B 3/0422; B05B 3/1092; B05B 15/60; B05B 15/65; B05B 3/0426; B05B 3/1042; B05B 5/0426

See application file for complete search history.

(56) References Cited

U.S. PATENT DOCUMENTS

| | | | | |
|---|---|---|---|---|
| 5,078,321 | A | 1/1992 | Davis et al. | |
| 6,164,561 | A * | 12/2000 | Yoshida | B05B 5/1691 222/326 |
| 9,437,969 | B2 * | 9/2016 | Witter | F16B 21/12 |
| 9,901,942 | B2 | 2/2018 | Nolte et al. | |
| 2001/0015386 | A1 | 8/2001 | Pruss | |
| 2002/0017239 | A1 | 2/2002 | Di Gioia et al. | |

(Continued)

FOREIGN PATENT DOCUMENTS

| | | |
|---|---|---|
| CN | 1057410 A | 1/1992 |
| CN | 101687207 A | 3/2010 |

(Continued)

OTHER PUBLICATIONS

Search Report issued in connection with French patent application No. 1652390, dated Dec. 12, 2016, 2 pages.

(Continued)

*Primary Examiner* — Christopher R Dandridge
(74) *Attorney, Agent, or Firm* — Duane Morris LLP

(57) ABSTRACT

The invention relates to a sprayer, comprising an air guiding element and means for fastening the air guiding element on a fixed member of the sprayer. The fastening means comprise at least one magnetic attraction means mounted on a first component from among the air guiding element and the fixed member and at least one part made from a ferromagnetic material, which is intended to cooperate with the magnetic attraction means and which is mounted on or formed by the other component from among the air guiding element and the fixed element.

14 Claims, 4 Drawing Sheets

(56) References Cited

U.S. PATENT DOCUMENTS

Figure 1:
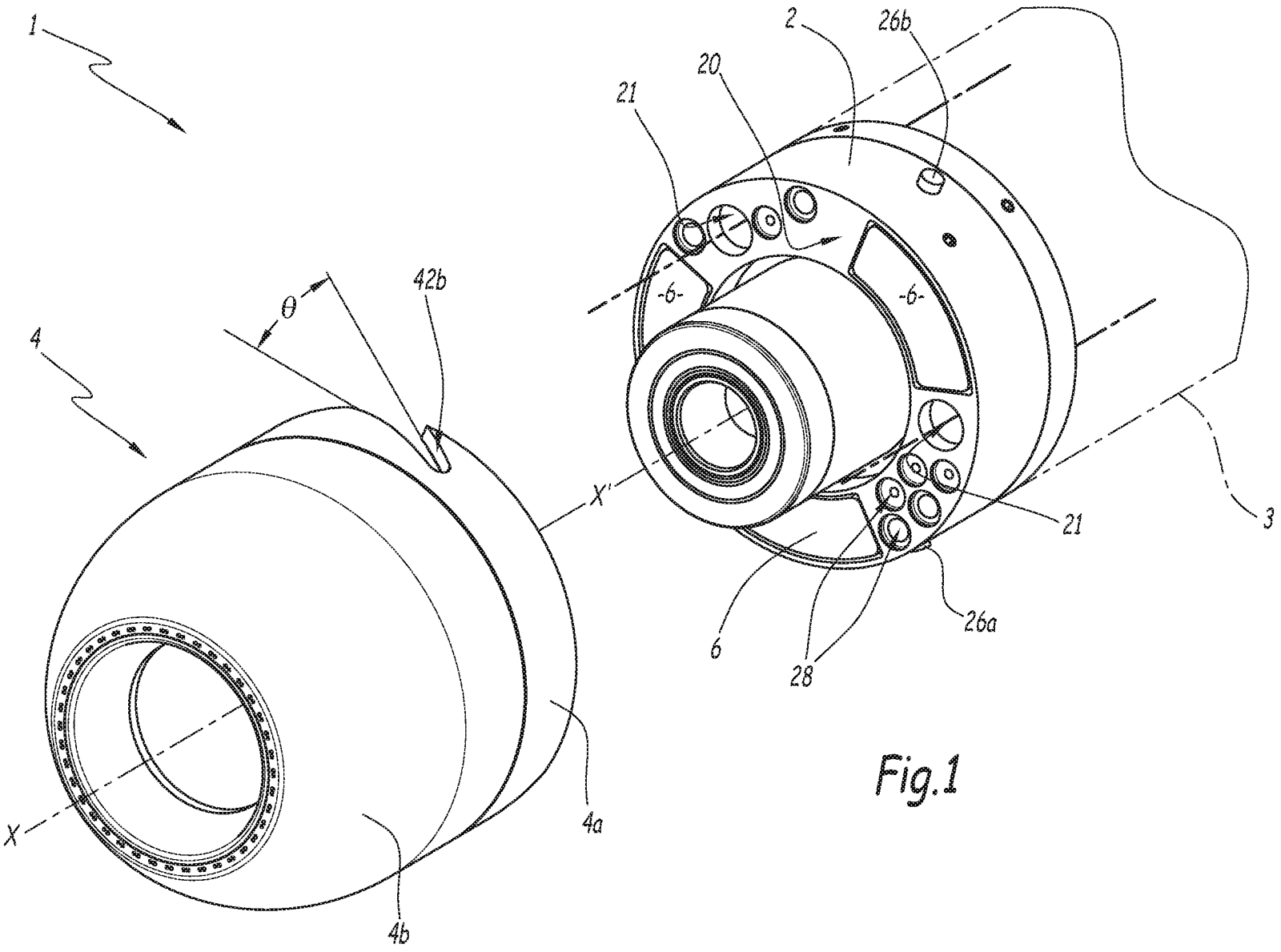

| | | | | |
|---|---|---|---|---|
| 2003/0234299 | A1* | 12/2003 | Hosoda | B05B 3/1064 239/302 |
| 2004/0140378 | A1* | 7/2004 | Merabet | B05B 3/1042 239/700 |
| 2005/0172892 | A1* | 8/2005 | Thome | B05B 3/1035 239/700 |
| 2007/0090204 | A1* | 4/2007 | Nolte | B05B 3/1042 239/600 |
| 2008/0149026 | A1 | 6/2008 | Cedoz et al. | |
| 2008/0164342 | A1 | 7/2008 | Ballu et al. | |
| 2012/0118996 | A1 | 5/2012 | Ballu et al. | |
| 2015/0140199 | A1* | 5/2015 | Borchardt | B05B 12/00 427/8 |
| 2015/0258554 | A1 | 9/2015 | Steur et al. | |

FOREIGN PATENT DOCUMENTS

| | | | |
|---|---|---|---|
| CN | 102427888 | A | 4/2012 |
| DE | 10 2004 032 045 | A1 | 1/2006 |
| EP | 0365225 | | 4/1990 |
| EP | 0567436 | | 10/1993 |
| JP | 199016447 | | 6/1990 |
| JP | 1994134350 | | 5/1994 |
| JP | 2003-524523 | | 8/2003 |
| JP | 2007520343 | | 7/2007 |
| JP | 2009119402 | | 6/2009 |
| JP | 2018515336 | | 6/2018 |
| JP | 2008510608 | | 4/2020 |
| RU | 2514984 | C2 | 5/2010 |
| RU | 101944 | U1 | 10/2010 |
| SU | 1214228 | A1 | 2/1986 |
| WO | 20004024338 | A2 | 3/2004 |
| WO | 2015/191323 | A1 | 12/2015 |
| WO | 2015191323 | A1 | 12/2015 |
| WO | 2016191240 | | 12/2016 |

OTHER PUBLICATIONS

Search Report dated Jun. 9, 2017 In European Patent Application No. 17161725.1.

* cited by examiner

COATING SPRAYER, METHOD FOR ASSEMBLING AND DISASSEMBLING

The present invention relates to a coating sprayer, provided to be mounted at the end of the arm of a multiaxial robot, with a to-and-fro manipulator more commonly called a reciprocator, or with a fixed unit. Multiaxial robots are in particular used on automobile painting lines to deposit a coating, such as a primer, varnish or paint.

In order to obtain automation in the form of fine droplets and good control of the jet, some sprayers are equipped with a high-speed turbine, which rotates a bowl around a spraying axis. Furthermore, a skirt is fastened on the stator of the turbine to diffuse an air jet inside and/or outside the cloud of coating product, so as to stabilize this cloud. This skirt has two parts: it comprises an inner part and an outer part that are arranged to diffuse "straight" and/or "vortex" air.

The skirt is the component of the sprayer that makes it possible, inter alia, to adjust the size of the impact and to obtain a stable and regular spraying quality. The skirt is mounted in the immediate vicinity of the rotary bowl. It is therefore very exposed to the cloud of coating product and must therefore be disassembled and cleaned regularly. As an example, in a production organization system using three eight-hour shifts, the skirt must be disassembled and cleaned upon each change of station, or every eight hours.

In a known manner, the skirt is fastened on the body of the sprayer either by directly screwing the outer part of the skirt on the body of the sprayer, or using a special nut that is screwed on the body of the sprayer and that maintains the skirt via a shoulder. The skirt is traversed by independent compressed air circuits. Often, these independent circuits include one or several directional air circuits, called "straight" air, one or several additional air circuits, called "vortex" air, and one or several cleaning solvent circuits. A skirt therefore comprises between five and eight independent circuits, which are connected to complementary circuits defined in the body of the sprayer. The skirt must therefore be positioned angularly relative to the body of the sprayer in a predefined manner. This predefined angular position is maintained by an additional component, such as a radial pin. The radial pin makes cleaning operations complicated and tedious, since many sealing gaskets must be changed periodically.

Furthermore, when the skirt is screwed on the body of the sprayer, a very fine screw pitch should be used in order to obtain good sealing at the junction between the body of the sprayer and the skirt. As an example, for a diameter comprised between 90 mm and 140 mm, the screw pitch is comprised between 0.8 mm and 2 mm. This very fine screw pitch requires special attention during the assembly and disassembly of the skirt. Indeed, an incorrect alignment of the threads during the screwing or unscrewing of the skirt can damage the parts. Furthermore, for weight and safety reasons, the means used to keep the skirt in its predefined angular position are generally made from plastic or a light metal alloy. However, these materials do not tolerate successive assembly and disassembly operations well, since coating residue may infiltrate the threads of the skirt and/or the body of the sprayer, which can cause material to pull out and partial or total destruction of the sprayer.

The invention more particularly intends to resolve these drawbacks by proposing a coating sprayer with which the successive assembly and assembly operations of the skirt do not damage the components of the sprayer.

To that end, the invention relates to a sprayer intended to be mounted on a robot and comprising an air guiding element and means for fastening the air guiding element on a fixed member of the sprayer. According to the invention, the fastening means comprise at least one magnetic attraction means mounted on a first component from among the air guiding element and the fixed member and at least one part made from a ferromagnetic material, which is intended to cooperate with the magnetic attraction means and which is mounted on or formed by the other component from among the air guiding element and the fixed element.

US 2003/234299 discloses several embodiments of a coating sprayer. The sprayer comprises a body defining a portion for receiving a sprayer unit and a portion for receiving a cartridge. This sprayer is specific in that it comprises magnetic fastening means to fasten the cartridge to the inside of the portion of the body. These magnetic fastening means can comprise permanent magnets or electromagnets. The spraying unit comprises an air guiding element, defining air discharge holes. The cartridge is provided to be replaced, and is therefore completely removable. It therefore cannot be considered a fixed member of the sprayer within the meaning of the invention. Furthermore, the magnetic fastening means mentioned in this publication are used to fasten the cartridge to the inside of the portion provided in the body, and not to fasten the air guiding element with the fixed body of the sprayer.

WO 2013/191323 discloses several embodiments of a spraying head for a sprayer device. In the first embodiment, the spraying head comprises a nozzle defining a fluid discharge passage and an air guiding element, which comprises two diametrically opposite horns, to generate atomizing air jets. The spraying head is fastened to a body of the gun. To that end, the gun comprises a pair of elastic tongues provided with respective openings. When the body of the gun and the spraying head are engaged in one another, the elastic tongues are elastically outwardly deformed until stops provided on the spraying head penetrate the inside of the openings. Page 7, lines 27 to 30, states that such fastening means could be replaced by magnets. The magnets mentioned in this passage of the description do not form means for fastening the air guiding element on a fixed member of the sprayer. In fact, the magnets relate to the fastening of the spraying head on the body of the gun. Furthermore, the stops are provided on a barrel on which the air guiding element is fastened. In particular, the air guiding element can be fastened rigidly or pivoting on the barrel. Furthermore, the disclosed material more particularly applies to a manual gun for applying a coating, and not a sprayer intended to be mounted on a robot.

Owing to the invention, the air guiding element can be assembled and disassembled without any risk of damaging the components of the sprayer, since no thread is used.

According to advantageous, but optional aspects of the invention, such a sprayer may include one or more of the following features, considered in any technically allowable combination:

The fixed member of the sprayer is a turbine stator, while each ferromagnetic part is mounted on the air guiding element, and each magnetic attraction means is mounted on the stator.

The magnetic attraction means is received in a recess defined in a shoulder of the stator, while each ferromagnetic part is received in a recess of the air guiding element, this recess being defined in a complementary shoulder of the air guiding element.

The fixed member of the sprayer is a turbine stator, while each ferromagnetic part is mounted on the stator, and each magnetic attraction means is mounted on the air guiding element.

Each magnetic attraction means is received in a recess defined in a shoulder of the air guiding element, while each ferromagnetic part is received in a recess of the stator defined in a complementary shoulder of the stator.

The fixed member of the sprayer is a turbine stator, while the air guiding element or the stator of the turbine is made from a ferromagnetic material.

The sprayer comprises orientation means, to orient the air guiding element automatically relative to the fixed member in a predefined angular position.

The orientation means comprise at least one pin and at least one corresponding notch or slot to receive the pin.

Each notch or slot is configured so that the air guiding element can rotate around a central axis relative to the fixed member when the pin is moved in the corresponding notch or slot.

Each notch or slot extends at least partially in a helical direction around the central axis.

The pitch of each notch or slot around a spraying axis is to the right seen from the side opposite the fixed member.

The pitch of each notch or slot around a spraying axis is to the left seen from the side opposite the fixed member.

Each notch is defined by the air guiding element, while each pin is supported by the fixed member.

Each slot is defined by the fixed member, while each pin is supported by the air guiding element.

Each pin does not protrude radially relative to the outer surface of the air guiding element.

The invention also relates to a method for assembling an air guiding element on a fixed member of a sprayer as previously described. This method consists of moving the air guiding element and the fixed member relative to one another until reaching a position in which the air guiding element is fastened to the fixed member by cooperation of the magnetic attraction means with the ferromagnetic part.

The invention lastly relates to a method for disassembling an air guiding element from a fixed member of a sprayer as previously described. The method consists of moving the air guiding element and the fixed member relative to one another until reaching a position in which the magnetic attraction means no longer cooperates with the ferromagnetic part.

Advantageously, but optionally, the relative movement between the guiding element and the fixed member during the assembly or disassembly is a translational movement along the central axis and/or a rotational movement around the central axis.

Advantageously, but optionally, the relative movement between the guiding element and the fixed member is a translational movement along the central axis and a tool bearing a wedge is used to separate the guiding element and the fixed member from one another axially during the disassembly.

Figure 2:
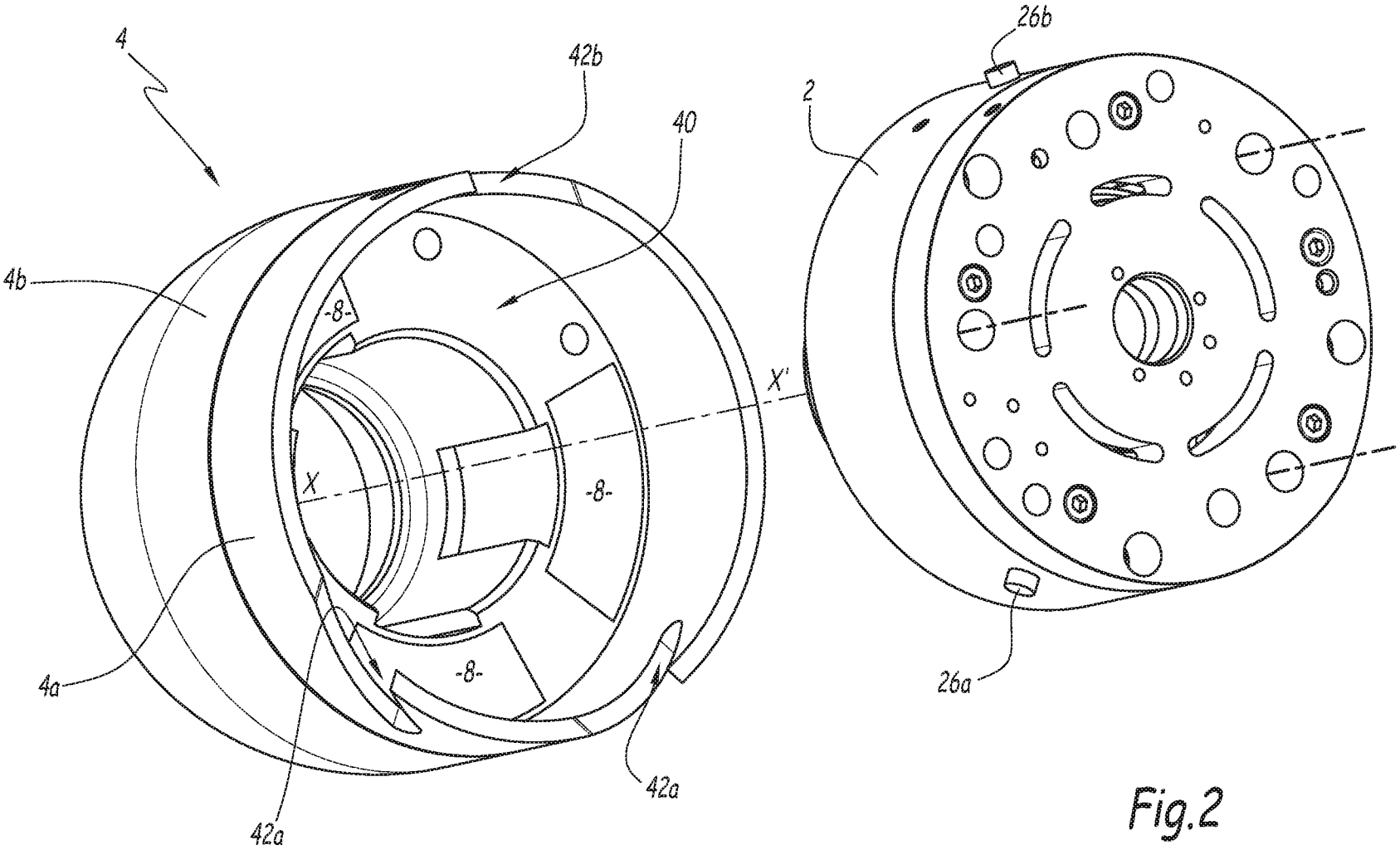
Figure 3:
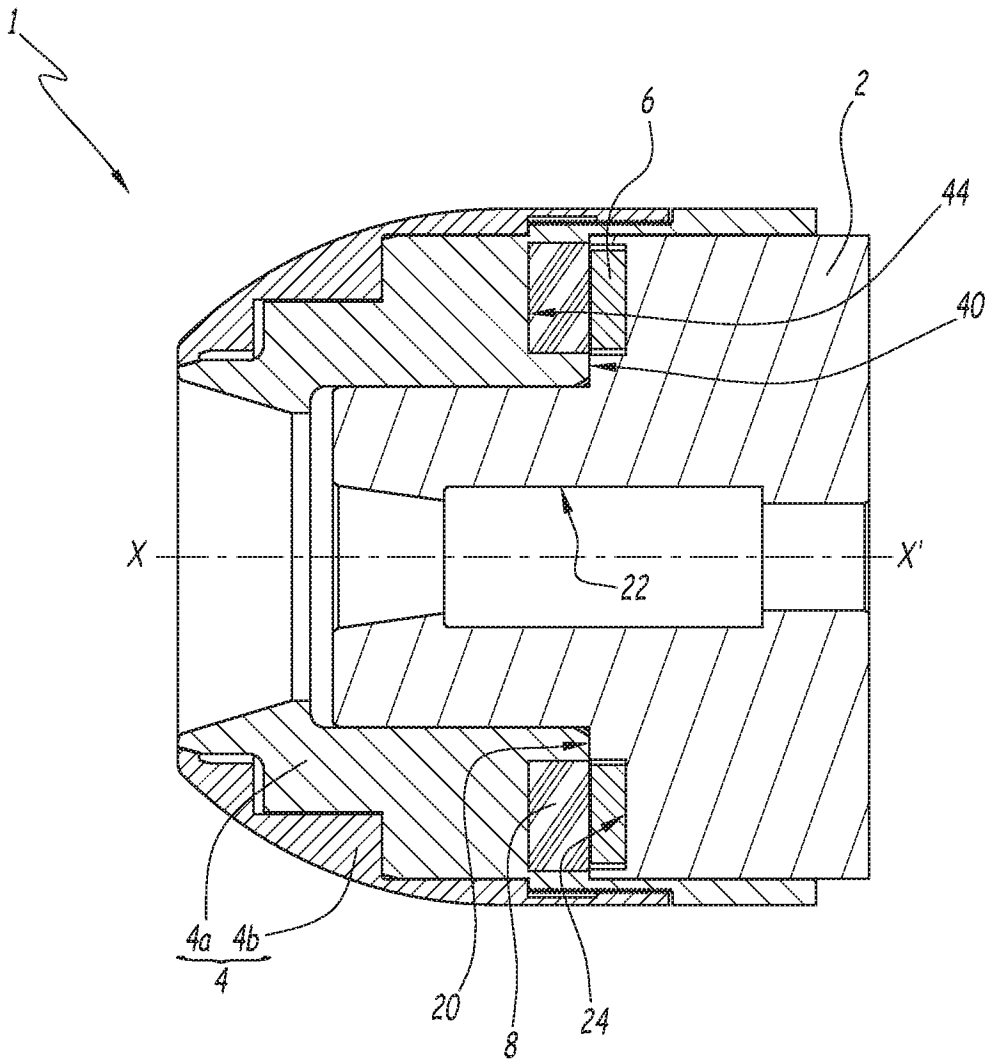
Figure 4:
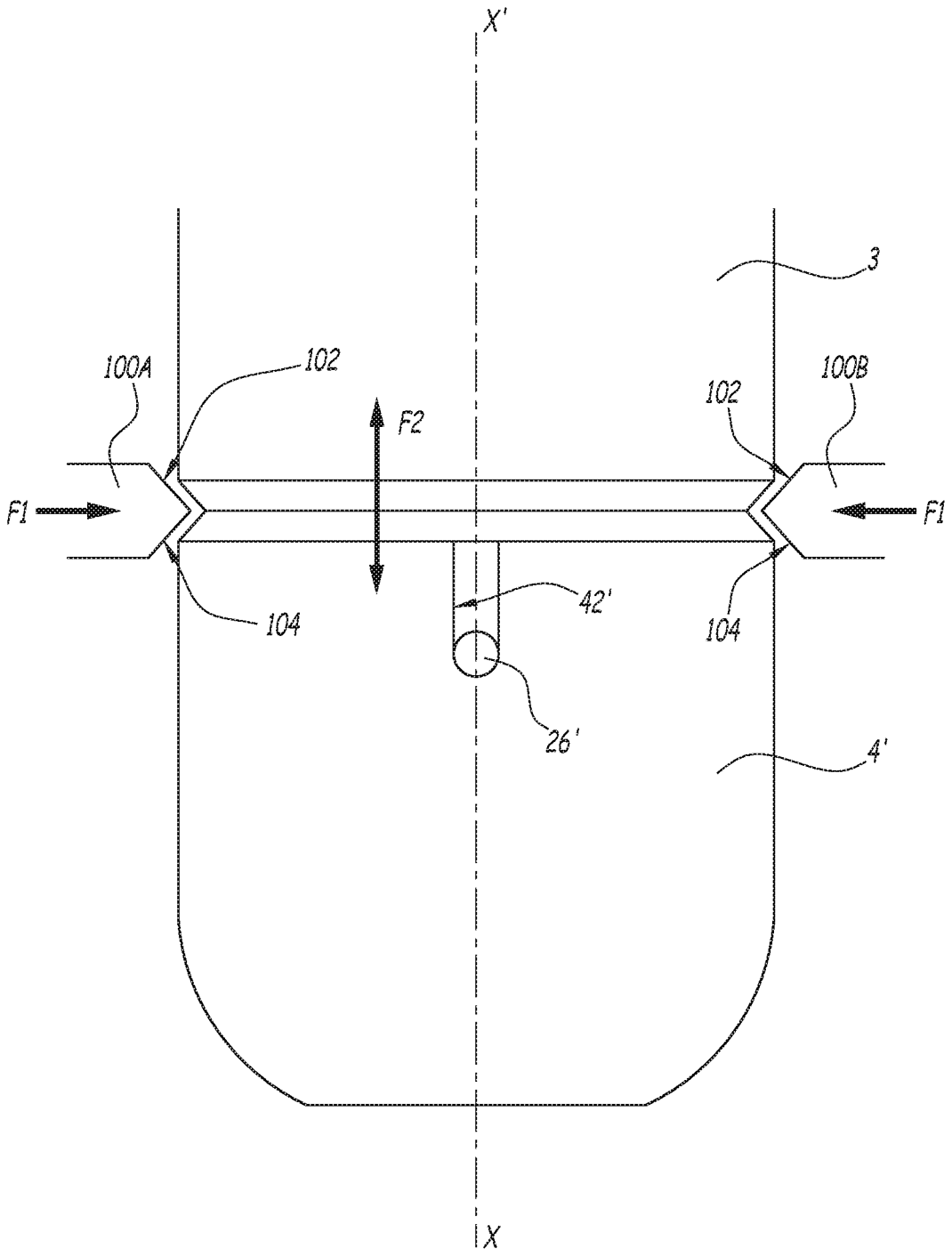

The invention and other advantages thereof will appear more clearly in light of the following description of two embodiments of a sprayer according to its principle, provided solely as an example and done in reference to the appended drawings, in which:

FIG. 1 is an exploded perspective view of a sprayer according to the invention, FIG. 2 is an exploded perspective view similar to that of FIG. 1, from another angle, FIG. 3 is a longitudinal sectional view of the sprayer in the assembled configuration, and FIG. 4 is an elevation view of a sprayer according to a second embodiment of the invention, shown jointly with a disassembly tool.

FIGS. 1 to 3 show a coating sprayer 1, for a coating in powder or liquid form. The sprayer 1 is intended to be mounted on the wrist of an arm of a multiaxial robot, not shown. This type of multiaxial robot is in particular used on automobile painting lines to apply a layer of primer, varnish or paint. Alternatively, the sprayer 1 can be mounted on a to-and-fro manipulate or, more commonly called reciprocator, or a fixed unit manipulator.

Advantageously, the sprayer 1 is an electrostatic sprayer.

The sprayer 1 locally has a geometry of revolution around an axis X-X', which forms a spraying axis for the coating product. The sprayer 1 comprises a body 3 shown diagrammatically in mixed lines in FIG. 1 only, and suitable for being fastened to the wrist of the robot. A high-speed turbine is suitable for being fastened on this body 3. This turbine is provided to rotate at a speed comprised between 1000 RPM and 110,000 RPM. It comprises a turbine stator 2 intended to be fastened on the body 3 of the sprayer and a rotor, which is not shown. In practice, a bowl is fastened to the rotor, in particular by magnetization. This is then called a rotary bowl sprayer. For the clarity of the drawing, the bowl is not shown in the figures. The stator 2 and the body 3 are fixed members of the sprayer 1.

In the present application, a front direction designates an axial direction parallel to the axis X-X' that is oriented in the spraying direction, i.e., to the left in FIG. 3. Conversely, a rear direction is an axial direction oriented opposite the spraying direction, i.e., to the right in FIG. 3.

A shoulder 20 decreases the outer diameter of the stator 2 of the turbine going forward. The turbine stator 2 defines a central bore 22 for receiving the rotor. The shoulder 20 of the stator 2 defines an annular surface perpendicular to the axis X-X'. This annular surface includes at least one recess 24, in which a magnetic attraction means 6 is received. In the example, this magnetic attraction means is a permanent magnet.

Advantageously, the stator 2 defines three recesses 24 that are distributed regularly around the axis X-X' and that each receive a magnet 6. The strength of the magnets 6 is sufficient to crush the sealing gaskets between the skirt and the body and to thus provide good sealing. This strength is comprised between 10 kN and 200 kN, preferably about 100 kN, relative to pulling out in the axial direction.

In the example, the magnets 6 are ring portions. However, the shape of the magnets 6 is not limiting. Thus, the magnets 6 can assume any shape suitable for the geometry of the sprayer, such as a shape with a square, rectangular, circular or elliptical section.

The stator 2 comprises at least one pin that protrudes radially outward relative to its outer surface of the stator 2. In the example, the stator 2 comprises three pins, among which two pins are referenced **26*a* and one pin is referenced 26*b*. The two pins 26*a* are the pins that are least spaced apart from one another. Only one of these two pins 26*a* is visible in FIG. 2. The pins 26*a* and 26*b*** are therefore distributed irregularly around the axis X-X'.

The stator 2 defines holes 21, two of which are visible in FIG. 1. The holes 21 are intended to receive screws to fasten the stator 2 to the body 3 of the sprayer 1.

The stator 2 is traversed by independent circuits 28, eight of which are visible in FIG. 1. The independent circuits 28 include at least one compressed air circuit. Advantageously, the independent circuits 28 include at least one directional air circuit, called "straight" air, an additional air circuit, called "vortex" air, and a cleaning solvent circuit.

An air guiding element 4 is fastened on a fixed member of the sprayer 1. In the example, this element is a skirt and the fixed member is the stator 2 of the turbine. Advantageously, the skirt comprises an inner part 4*a* and an outer part 4*b* screwed around the inner part 4*a*. As an alternative that is not shown, the skirt 4 is in a single piece. The skirt 4 has a geometry of revolution the axis X-X'. The inner part 4*b* of the skirt 4 includes a shoulder 40 complementary to the shoulder 20 of the stator 2 of the turbine. Thus, the shoulders 20 and 40 are in contact with one another in the mounted configuration of the skirt 4. The shoulder 40 decreases the inner diameter of the skirt 4 in the forward direction. The shoulder 40 forms a surface perpendicular to the axis X-X' defining at least one recess 44 in which a part 8 is housed made from a non-magnetized ferromagnetic alloy. In the example, the stator 2 defines three recesses 44. There are therefore as many magnets 6 as there are ferromagnetic parts 8. Thus, each magnet 6 cooperates with a corresponding part 8 to fasten the skirt 4 to the stator 2 of the turbine. The magnets 6 and the ferromagnetic parts 8 therefore together form fastening means for fastening the skirt 4 on the stator 2 of the turbine. Fastening the skirt 4 using magnetization makes it possible to eliminate the use of very fine screw pitches, which require special attention during the assembly and disassembly of the skirt 4 and are subject to deterioration.

The inner part 4*b* of the skirt 4 protrudes axially toward the rear relative to the outer part 4*a*. It therefore comprises a protruding rear portion, which defines at least one notch. In the example, the inner part 4*b* of the skirt 4 defines three notches, among which two notches are referenced 42*a* and one notch is referenced 42*b*. There are therefore as many notches as there are pins. The two notches 42*a* are those that are least spaced apart from one another. The notches 42*a* and 42*b* are therefore distributed irregularly around the axis X-X'. The notches 42*a* are respectively provided to guide the pins 26*a* during the fastening of the skirt 4 on the stator 2, while the notch 42*b* is provided to guide the pin 26*b*.

Each notch 42*a* and 42*b* advantageously has a length comprised between 10 mm and 50 mm, preferably about 20 mm.

Advantageously, each notch 42*a*, 42*b* is configured such that the skirt 4 can rotate around the axis X-X' and relative to the stator 2 when the corresponding pins 26*a*, 26*b* are moved in the notches 42*a*, 42*b*. This procures the advantage of making the skirt 4 easier to disassemble, since the forces necessary to separate the skirt 4 and the stator 2 from one another are lower relative to a configuration where the skirt is detached from the stator 2 by a purely axial movement.

Advantageously, each notch 42*a* or 42*b* extends along a helical direction around the central axis X-X', with a helix angle θ comprised between 5° and 75°, in particular about 60°. This angle θ is measured relative to a direction orthoradial to the axis X-X'. In the example, the pitch of each notch 42*a* and 42*b* around the axis X-X' is to the right seen from the side opposite the fixed member 2, i.e., seen from the left in FIGS. 1 and 3. This means that the skirt 4 must be rotated to the left seen from the side opposite the fixed member 2 in order to fasten the skirt 4 and the fixed member 2 together. In an alternative that is not shown, this pitch may be on the left when seen from the side opposite the fixed member 2.

However, as an alternative that is not shown, the notches 42*a* and 42*b* extend in a different direction. For example, the notches 42*a* and 42*b* can extend parallel to the axis X-X', obliquely or bent. It is also possible to consider an embodiment where the notches extend, toward the front from the rear edge of the skirt 4, first in an axial direction, then in an oblique, helical or curved direction.

Advantageously, the portion of the part 4*a* of the skirt that defines the notches 42*a* and 42*b* has a radial thickness substantially equal to the height of the pins 26*a* and 26*b*, such that the pins 26*a* and 26*b* do not protrude radially outward in the assembled configuration of the sprayer 1. Each pin 26*a* and 26*b* therefore does not protrude radially relative to the outer surface of the skirt 4. The pins 26*a* and 26*b* therefore do not generate turbulence during the movement of the robot.

The skirt 4 defines independent circuits, complementary to the circuits 28 defined in the stator 2; that is why the angular position of the skirt 4 around the axis X-X' relative to the stator 2 of the turbine is predefined. Otherwise, the circuits of the skirt 4 would not be connected to those defined in the stator 2 of the turbine.

To mount the skirt 4 manually on the stator 2 of the sprayer 1, the two elements should be brought axially closer to one another until reaching a position in which the air guiding element 4 is fastened to the fixed member 2 by cooperation of the magnetic attraction means 6 with the ferromagnetic part 8.

More specifically, the skirt 4 is oriented around the axis X-X' so as to align the pins 26*a* with the notches 42*a* and the pin 26*b* with the notch 42*b*. The position of the notches 42*a* and 42*b* then forms mechanical mistake-proofing means preventing the operator from making a mistake when assembling the skirt 4 on the stator 2. The pins 26*a* and 26*b* of the stator 2 them penetrate the corresponding notches 42*a* and 42*b* of the skirt 4. The notches 42*a* and 42*b* are configured so that the skirt rotates automatically around the axis X-X' as the pins 26*a* and 26*b* penetrate toward the bottom of the corresponding notches, i.e., as one brings the skirt 4 and the stator 2 of the turbine close together. The ferromagnetic parts 8 are attracted by the magnets 6 and the pins 26*a* and 26*b* arrive at the bottom of the notches 42*a* and 42*b*. The skirt is then oriented in the predefined angular position, in which a sealed connection can be made between the respective circuits of the skirt 4 and the stator of the turbine 2. The notches 42*a*, 42*b* and the pins 26*a*, 26*b* therefore form means for automatically orienting the skirt around the axis X-X' in a predefined angular position relative to the stator 2 of the turbine.

The skirt 4 can also be mounted automatically using the movement of the multiaxial robot. In this case, the skirt 4 is mounted on a support on which it is immobilized in rotation around its axis X-X', but freely translates along its axis X-X'. Alternatively, the skirt 4 can also be blocked in translation. An example support is a column, inside which the skirt 4 is received. To assemble the skirt 4, the multiaxial robot brings the fixed member 2 into a configuration in which each pin 26*a* and 26*b* is across from a corresponding notch 42*a* and 42*b* and performs a rotational movement around the central axis X-X' to engage each of the pins 26*a* and 26*b* inside the corresponding notch. More specifically, the relative movement between the guiding element 4 and the fixed member 2 is both a translational movement along the central axis X-X' and a rotational movement around the central axis X-X'.

To disassemble the skirt 4 from the stator 2 of the turbine manually, the air guiding element 4 and the fixed member 2 should be oriented relative to one another around the central axis X-X' until reaching a position in which the magnetic attraction means 6 no longer cooperates with the ferromagnetic part 8.

More specifically, the skirt 4 is pivoted around the axis X-X' in order to move the pins 22*a* and 22*b* in a direction opposite the bottom of the notches 42*a* and 42*b*. This makes it possible to skew the ferromagnetic parts 8 and the magnets 6: the magnets 6 are no longer radially opposite the parts 8. The magnetic attraction force between the magnets 6 and the ferromagnetic parts 8 is thus reduced.

This operation can thus be done automatically, as outlined below.

The multiaxial robot brings the sprayer 1, then mounted at the end of the arm of the robot, onto a support configured to prevent the skirt 4 from rotating around its axis X-X'. On the support, the skirt 4 nevertheless remains freely translating along the axis X-X'. Alternatively, the skirt 4 is also immobilized on the support in translation along the axis X-X'. Once the skirt 4 is immobilized in rotation, the robot performs a rotational movement around the central axis X-X' to free each of the pins 26*a* and 26*b* outside the corresponding notch. More specifically, the relative movement between the guiding element 4 immobilized on the support and the fixed member 2 mounted at the end of the arm of the robot is both a translational movement along the central axis X-X' and a rotational movement around the central axis X-X'. The elements 6 and 8 are then no longer across from one another and there is no longer any magnetic attraction, and the skirt 4 can be cleaned or replaced.

FIG. 4 shows a second embodiment of a sprayer according to the invention. Below, only the differences with respect to the first embodiment are described. The elements of the sprayer of the second embodiment that are comparable to those of the first embodiment bear numerical references identical to those previously used, but followed by an apostrophe (').

In this embodiment, the skirt 4' defines one or several notches 42' that each extend parallel to the central axis X-X'.

The manual assembly of the skirt 4' on the fixed member is then done simply by orienting the skirt 4' in a configuration where each notch 42' is across from a corresponding pin 26' and axially bringing the skirt 4 and the fixed member closer together. This operation can also be done by the multiaxial robot itself, in which case the robot automatically orients the fixed member in the aforementioned configuration. Once this configuration is reached, the skirt 4 moves automatically, following a translational movement, toward the fixed member under the effect of the magnetic attraction.

To disassemble the skirt 4, a specific tool is used, in particular a clamp, comprising two jaws 100A and 100B. Each of the jaws 100A and 100B comprises at least one bevel 102, in particular two bevels 102 and 104, intended to cooperate with inclined surfaces of the skirt 4' and the body 3 of the sprayer 1, respectively. Indeed, the jaws 100A and 100B are positioned diametrically opposite around the sprayer 1 and are moved radially toward one another in a space between the skirt 4 and the body 3 of the sprayer 1, as shown by the arrows F1 in FIG. 4. The first bevel 102 of each jaw 100A and 100B bears against a complementary inclined surface of the body 3 of the sprayer 1, while the second bevel 104 bears against a complementary inclined surface of the skirt 4'. The radial force applied by the jaws 100A and 100B on both the skirt 4 and the body 3 is converted into an axial force along the axis X-X' by wedge effect, which axially separates the skirt 4' and the body 3 from the sprayer 1, as shown by the double arrow F2 in FIG. 4. The magnetic attraction force between the elements 6 and 8 is therefore reduced, and the skirt 4' can be detached from the rest of the sprayer with no axial force. The bevels 102 and 104 of each jaw of the tool therefore form a wedge.

The tool can be manipulated by an operator or an automaton.

As an alternative that is not shown and is applicable to all of the embodiments, the skirt 4 is fastened directly on the body 3 of the sprayer, by fastening means comparable to those described above. In this case, the turbine does not include independent circuits 28. The compressed air then for example circulates in channels arranged between the skirt 4 and the stator 2 of the turbine.

According to another alternative that is not illustrated, each magnet 6 is supported by the skirt 4, while each ferromagnetic part 8 is supported by the stator of the turbine 2 or by the body of the sprayer 3, depending on the embodiment in question.

According to another alternative that is not shown, the skirt 4 or the stator 2 is made from a ferromagnetic material, in particular a non-magnetized ferromagnetic alloy.

According to another alternative that is not shown, the pin(s) 26*a*, 26*b* belong to the skirt 4 and protrude radially inward. In this case, slots are defined on the outer radial surface of the stator 2 or on the outer radial surface of the body 3 of the sprayer 1 of the turbine, depending on the considered embodiment. These are called positioning ramps. The slots can extend in any direction, in particular in the directions described above relative to the notches 42*a* and 42*b*. In the case of helical slots, these slots each have a left pitch or a right pitch around the axis X-X'.

According to another alternative that is not shown, a ring is mounted rotatably around the part with a narrower diameter of the stator 2 of the turbine. Advantageously, this ring includes several magnets distributed with alternating polarities along a peripheral direction around the central axis of the ring. The ring therefore does not exert the same magnetic effect irrespective of its angular position. Indeed, depending on the angular position of the ring, it may either attract ferromagnetic elements, or repel them. In configuration of the skirt 4 mounted on the body 2, it suffices to pivot the ring around the body 2 to push the skirt 4 back from the body 2, which facilitates the disassembly of the skirt 4.

According to another alternative that is not shown, the skirt 4 comprises an outer housing, for example in the form of a blind hole, to receive the lug of a pin wrench. This pin wrench then makes it possible to rotate the skirt 4 around the central axis X-X' until reaching a position in which the magnetic attraction means 6 no longer cooperates with the ferromagnetic part 8. This wrench comprises a handle that is extended by a semicircular hook bearing the lug and adapted to the outer diameter of the skirt 4.

According to another alternative, the disassembly of the skirt 4 can be done using a strap wrench.

According to another alternative that is not shown, the magnetic attraction means is an electromagnet. In this case, the disassembly of the skirt 4 is made easier because the electromagnet can be deactivated by cutting its power supply.

The technical features of the embodiment and alternatives considered above may be combined with one another to create new embodiments of the invention.

The invention claimed is:

1. A sprayer to be mounted on a robot, the sprayer comprising:

an air guide, the air guide being an air skirt, a fixed member of the sprayer, the fixed member being a turbine stator, at least one magnet mounted on a first component from among the air guide and the fixed member, and at least one ferromagnetic part made from a ferromagnetic material, which is intended to cooperate with the at least one magnet and which is mounted on or defined by the other component from among the air guide and the fixed member, wherein the air guide is fastened to the fixed member by the at least one magnet and the at least one ferromagnetic part, the at least one magnet and the at least one ferromagnetic part generate a magnetic attraction force between the at least one magnet and the at least one ferromagnetic part between 10 kN and 200 kN, the fixed member is traversed by independent circuits and complementary independent circuits, complementary to the independent circuits traversing the fixed member, that are arranged through the air guide, the independent circuits including at least one compressed air circuit between the turbine stator and the air skirt, and the air guide and the fixed member are provided with matching elements arranged to position the fixed member with respect to the air guide in a predefined angular position, the predefined angular position being configured to connect the independent circuits of the fixed member and the complementary independent circuits of the air guide.

2. The sprayer according to claim 1, wherein each ferromagnetic part is mounted on the air guide, while each magnet is mounted on the turbine stator.

3. The sprayer according to claim 2, wherein the at least one magnet is received in a recess defined in a shoulder of the turbine stator, while each ferromagnetic part is received in a recess of the air guide, this recess being defined in a complementary shoulder of the air guide.

4. The sprayer according to claim 1, wherein each ferromagnetic part is mounted on the turbine stator, while each magnet is mounted on the air guide.

5. The sprayer according to claim 4, wherein the at least one magnet is received in a recess defined in a shoulder of the air guide, while each ferromagnetic part is received in a recess of the turbine stator defined in a complementary shoulder of the turbine stator.

6. The sprayer according to claim 1, wherein the air guide or the turbine stator is made from a ferromagnetic material.

7. The sprayer according to claim 1, wherein each magnet is a permanent magnet or an electromagnet.

8. The sprayer according to claim 1, wherein the air guide is automatically orientable relative to the fixed member in the predefined angular position.

9. The sprayer according to claim 8, wherein the sprayer comprises at least one pin and at least one corresponding notch or slot to receive the at least one pin for orienting the air guide.

10. The sprayer according to claim 9, wherein each notch or each slot is configured so that the air guide can rotate around a central axis relative to the fixed member when the at least one pin is moved in the at least one corresponding notch or slot.

11. The sprayer according to claim 10, wherein each notch or slot extends at least partially in a helical direction around the central axis with a helix angle between 5° and 75°.

12. The sprayer according to claim 11, wherein each notch or slot has a slant orientation around a spraying axis to the right seen from the side opposite the fixed member.

13. The sprayer according to claim 9, wherein:

each notch is defined by the air guide, while each pin is supported by the fixed member, or each slot is defined by the fixed member, while each pin is supported by the air guide.

14. The sprayer according to claim 1, wherein the circuits of the air guide and the circuits traversing the fixed member are connected only in the predefined angular position.

* * * * *